US007458136B2

(12) United States Patent
Duteil

(10) Patent No.: US 7,458,136 B2
(45) Date of Patent: Dec. 2, 2008

(54) SHOCK-ABSORBING SAFETY BELT BUCKLE

(75) Inventor: Regis Duteil, Beaubec la Rosière (FR)

(73) Assignee: Autoliv Development AB, Vargarda (SE)

( * ) Notice: Subject to any disclaimer, the term of this patent is extended or adjusted under 35 U.S.C. 154(b) by 0 days.

(21) Appl. No.: 11/926,831

(22) Filed: Oct. 29, 2007

(65) Prior Publication Data

US 2008/0127466 A1 Jun. 5, 2008

Related U.S. Application Data

(63) Continuation of application No. PCT/SE2006/000403, filed on Apr. 4, 2007.

(30) Foreign Application Priority Data

Apr. 27, 2005 (DE) ..... 10 2005 019 496
Apr. 13, 2006 (EP) ..... PCT/EP2006/003404

(51) Int. Cl.
*A44B 11/00* (2006.01)

(52) U.S. Cl. ..... 24/633; 24/640

(58) Field of Classification Search ..... None
See application file for complete search history.

(56) References Cited

U.S. PATENT DOCUMENTS 5,133,115 A * 7/1992 Bock ..... 24/633
5,216,788 A * 6/1993 Bock ..... 24/633
5,496,068 A * 3/1996 Ball et al. ..... 280/806
6,233,794 B1 * 5/2001 Kohlndorfer et al. ..... 24/641
7,124,480 B2 * 10/2006 Kawai et al. ..... 24/633
7,370,393 B2 * 5/2008 Hlavaty et al. ..... 24/633
2005/0086777 A1 * 4/2005 Kawai et al. ..... 24/633
2006/0059667 A1 * 3/2006 Hlavaty et al. ..... 24/633

FOREIGN PATENT DOCUMENTS

EP 0 212 507 B1 2/1990

* cited by examiner

*Primary Examiner*—Jack W. Lavinder
(74) *Attorney, Agent, or Firm*—Brinks Hofer Gilson & Lione

(57) ABSTRACT

A seatbelt buckle for receiving and locking an insert tongue, said seatbelt buckle comprising a housing, a bolt which locks the insert tongue, and a slide button which acts upon the bolt, wherein an inertial mass is provided for shockproofing of the seatbelt buckle. The inertial mass is mounted and guided on a guide disposed on the slide button and/or the housing. The slide button including a catch which is located apart from guide and opposite the bearing axis of the coupling lever. The bearing axis being fixed to the housing, wherein two arms of the coupling lever directly engage the inertial mass and the catch of the slide button.

6 Claims, 1 Drawing Sheet

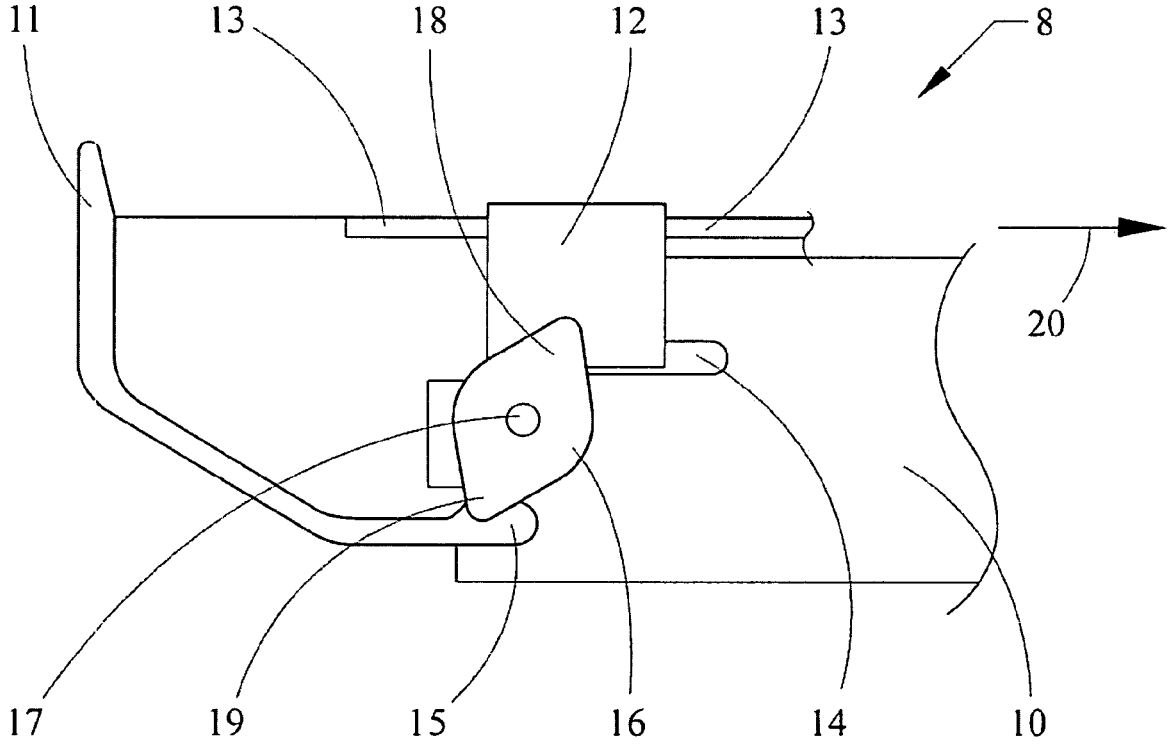
11
13
18
12
13
8
20
17
19
15
16
14
10

SHOCK-ABSORBING SAFETY BELT BUCKLE

CROSS REFERENCE TO RELATED APPLICATIONS

This application claims priority to PCT Patent Application Number PCT/EP2006/003404 filed Apr. 13, 2006 and DE Patent Application Number 10 2005 019 496.6 filed Apr. 27, 2005.

FIELD OF THE INVENTION

The invention relates to a seatbelt buckle for a motor vehicle belt restraint system for receiving and locking an insert tongue and particularly to a seatbelt buckle having features to reduce inadvertent release in response to inertial forces.

BACKGROUND OF THE INVENTION

A seatbelt buckle is described in EP 0 212 507 B1. In seatbelt buckles of this type, it is important to design them as shockproof. For example, when the seatbelt buckle is accelerated, as part of a tensioning action, and then abruptly decelerated at the end of the tensioning path, the forces acting in the direction of motion of the slide button caused by acceleration, may actuate the slide button into the decelerated buckle housing due to its own mass inertia and thereby opening the buckle. As per an example described in EP 0 212 507 B1, an inertial mass is arranged in the buckle housing so that it slides linearly in the direction of motion of the slide button. Because of the motion relative to the housing caused by the forces of acceleration, the inertial mass pivots a two-arm coupling lever rotatably mounted in the housing in such a manner that the free arm of the coupling lever intervenes in the motion path of the slide button. This thus prevents an insertion and opening movement of the slide button acting in the same direction as the motion of the inertial mass.

However, the seatbelt buckle in accordance with the prior art may be associated with the disadvantage that the separate arrangement of the linearly moving inertial mass, along with its associated guide and support in the housing of the seatbelt buckle, has a large space requirement so that the buckle body must be designed to be large in size. The known solution additionally means increased expense for manufacture and assembly. Finally, the inertial forces of the inertial mass must be matched to the inertial force acting on the slide button very exactly so that the coupling lever, when triggered, will pivot into the motion path of the slide button in a timely manner before the slide button is in motion.

SUMMARY OF THE INVENTION

The present invention seeks to overcome these concerns and to provide a simplified construction of a seatbelt buckle and to improve its functional reliability.

In at least one embodiment of the present invention, an inertial mass is mounted and guided on the slide button and/or on the housing of the buckle. The slide button may include a catch, which is located apart from a guide for the inertial mass and opposite a bearing axis of the coupling lever. The bearing axis is fixed to the housing and the two arms of the coupling lever directly engage the inertial mass and the catch of the slide button. The invention has the advantage that the space requirement for accommodating the inertial mass in the seatbelt buckle is reduced because the inertial mass is guided on the slide button itself. Because of the direct engagement of the coupling lever on the inertial mass and slide button, there is forced coupling of the two components with and against one another so that there is functional reliability when acceleration forces occur. The presence of rotational forces may be prevented due to the arrangement of the connection points of the coupling lever opposite the inertial mass on one side and the slide button on the other side. The mass of the inertial mass and the dimension of the lever arms are defined in such a manner, that moments of substantially equal size may occur when accelerations occur, so that the buckle is designed to have reduced sensitivity to inadvertent release due to inertial forces and is therefore regarded as shockproof.

In one example of the invention it is provided that a linear guide permitting relative motion of the slide button to the inertial mass is configured on the slide button. This also provides the option of mounting the inertial mass on the slide button in advance so that the final assembly of the seatbelt buckle is correspondingly facilitated.

In another example of the invention, the connection between inertial mass and the coupling lever, and the connection between the coupling lever and the catch of the slide button are each configured as a pin/slot connection. Since the working lever arms change because of the pivoting of the coupling lever, and the linear motion of slide button and inertial mass, appropriate free play may exist in the region where the components are connected together.

The relative movements may be advantageously adjusted if, for example, the connections between the inertial mass and the coupling lever on one side, and between the coupling lever and the catch of the slide button on the other side are located on different sides of a plane running through the bearing axis of the coupling lever and perpendicular to a plane of motion of the slide button. In particular, it may be provided that when the coupling lever is in its starting position with the slide button unactuated, the coupling lever is arranged inclined against the direction of motion of the slide button in such a manner that the connection between the catch of the slide button and the coupling lever is closer to the insert side for the insert tongue than the connection between the coupling lever and inertial mass.

BRIEF DESCRIPTION OF THE DRAWINGS

FIG. 1 is a partial side view of the seatbelt buckle assembly in accordance with at least one embodiment of the present invention.

DETAILED DESCRIPTION OF THE INVENTION

One embodiment of the present invention is a buckle of the configuration of the buckle described in single parts are provided in detail in EP 0 212 507 B1, the disclosure of which is incorporated herein by reference, with additional components and design features described herein.

Referring now to FIG. 1, a slide button 11 slides on a housing 10 of a seatbelt buckle 8 (partially illustrated). The slide button 11 being illustrated in its starting position in the drawing. The slide button 11 can be inserted into the housing 10 in the direction of arrow 20. By manually actuating the slide button 11 to move it in the right-hand direction, the buckle 8 releases a belt tongue (not shown).

An inertial mass 12, which is mounted on the slide button by a linear guide 13, is arranged to slide along the linear guide 13, which is positioned on the slide button 11. Since the inertial mass 12 is able to slide relative to the housing 10, the inertial mass 12 moves and is guided in a slot 14 configured in the housing 10 such that at the same time, the guiding of the inertial mass 12 toward the slide button 11 fixes the slide button 11 relative to the housing 10.

Alternatively, the inertial mass 12 can also be mounted to slide on the housing 10, which can also comprise a cover (not illustrated). Important for mounting and guiding the inertial mass 12 is only that no rotational acceleration be transmitted to the slide button 11 when inertial forces act on the inertial mass.

Within the housing 10, a two-arm coupling lever 16 is provided, one arm 18 of which engages with the inertial mass 12, and is rotatably mounted pivoting around a bearing axis 17 fixed to the housing. The opposite arm 19 of the coupling lever 16 engages with a catch 15 correspondingly arranged on the slide button 11. The configuration of the coupling lever 16 and of its bearing axis 17 on the housing 10 are configured such that the linear guide 12 and the catch 15 of the slide button 11 are substantially symmetrically mounted and connected, so that the lever arms 18 and 19 interact with inertial mass 12 and with catch 15 of the slide button 11. This results in a particularly simple type of mass balance, wherein other lever ratios can also be employed with corresponding design effort.

If the slide button 11 is displaced relative to the housing 10 in the direction of arrow 20 to actuate the seatbelt buckle for unlocking the buckle, the catch 15 of the slide button 11 presses on the associated arm 19 of the coupling lever 16 and causes it to pivot counterclockwise so that the arm 18 of the coupling lever 16 displaces the inertial mass 12 along the linear guide 13 configured on the slide button 11 in a direction opposite the direction of motion of slide button 11 and the arrow 20. This means that the linear guide 13 may have a total length on the slide button 11 that permits the motion of slide button 11 and inertial mass 12 relative to one another required for the unlocking stroke of the slide button.

If the seatbelt buckle 8 is subjected to tension and consequently also moves in the direction of arrow 20, and if the housing 10 is accordingly decelerated at the end of the tensioning action, the inertial mass 12, which is also accelerated during the tensioning action in the same direction with the slide button 11, now acts against displacement of the slide button 11 during deceleration. In a corresponding configuration of the inertial mass 12, the seatbelt buckle is also configured to be shockproof at the beginning to the tensioning movement and therefore resists movement in the direction of the arrow 20 upon acceleration such that the mass inertia of the inertial mass 12 does not open the slide button 11 at the beginning of the tensioning action. In particular, as part of its motion, the inertial mass 12 may provide at least one inertial force acting on the coupling lever 16 and pivots the coupling lever 16 clockwise so that the insertion and opening movement of the slide button 11 into the housing 10, which would cause counterclockwise pivoting of the coupling lever 16, is thereby stopped. This preferably provides shockproofing of the seatbelt buckle 8.

As a person skilled in the art will readily appreciate, the above description is meant as an illustration of the implementation of the principles of this invention. This description is not intended to limit the scope or application of this invention in that the invention is susceptible to modification, variation and change, without departing from the spirit of this invention, as defined in the following claims.

The invention claimed is:

1. A seatbelt buckle of the type for releasably engaging an insert tongue, the seatbelt buckle comprising, a housing, a slide button which slides in the housing and is for releasing the seatbelt buckle from a locked position, and an inertial mass which moves relative to the slide button in the direction of motion of the slide button and is coupled to the slide button by a two-arm coupling lever mounted in the housing, the two arm coupling lever including two arms, wherein the inertial mass is mounted and guided on a guide disposed on at least one of the slide button and the housing, the slide button includes a catch which is spaced apart from the guide and opposite a bearing axis of the two-arm coupling lever, the bearing axis being fixed to the housing, wherein the two arms of the coupling lever directly engage the inertial mass and the catch of the slide button so as to make the seatbelt buckle shockproof.

2. The seatbelt buckle according to claim 1, wherein the guide permits relative motion of the slide button to the inertial mass.

3. The seatbelt buckle according to claim 1, wherein the connection between inertial mass and coupling lever, and the connection between the coupling lever and the catch of the slide button are each configured as a pin/slot connection.

4. The seatbelt buckle according to claim 1, wherein the connections between inertial mass and coupling lever on one side, and between the coupling lever and the catch of the slide button on the other side are located on different sides of a plane running through the bearing axis of the coupling lever and perpendicular to a plane of motion of the slide button.

5. The seatbelt buckle according to claim 4, wherein when the coupling lever is in a starting position with the slide button unactuated, the coupling lever is arranged inclined against the direction of motion of the slide button such that the connection between the catch of the slide button and the coupling lever is closer to an insert side for the insert tongue than the connection between the coupling lever and inertial mass.

6. The seatbelt buckle according to claim 1, wherein the inertial mass in combination with the coupling lever and the slide button in combination with the coupling lever respectively form a first moment and a second moment of substantially equal size in opposing directions when the seatbelt buckle is acted upon by acceleration forces.

* * * * *